US005269736A

United States Patent [19]

Roberts

[11] Patent Number: 5,269,736

[45] Date of Patent: Dec. 14, 1993

[54] COMBINATION STATIONARY RECUMBENT EXERCISE APPARATUS AND UPPER BODY EXERCISER

[76] Inventor: Mark J. Roberts, 2185 Kyles Dr., Bartlesville, Okla. 74006

[21] Appl. No.: 2,589

[22] Filed: Jan. 11, 1993

Related U.S. Application Data

[63] Continuation of Ser. No. 726,278, Jul. 5, 1991, Pat. No. 5,178,593.

[51] Int. Cl.[5] ..... A63B 22/12

[52] U.S. Cl. ..... 482/62; 482/51; 482/56

[58] Field of Search ..... 482/56, 62, 57, 72, 482/37, 73, 51

[56] References Cited

U.S. PATENT DOCUMENTS

| | | | |
|---|---|---|---|
| 326,247 | 9/1985 | Root | 482/62 |
| 3,371,921 | 5/1973 | Andrews . | |
| 3,744,511 | 7/1973 | Gause et al. . | |
| 3,759,511 | 9/1973 | Zinkin et al. . | |
| 4,140,312 | 2/1979 | Buchmann | 482/62 |
| 4,423,863 | 1/1984 | Figueroa . . | |
| 4,537,396 | 8/1985 | Hooper . | |
| 4,589,656 | 4/1986 | Baldwin . | |
| 4,613,129 | 9/1986 | Schroeder et al. . | |
| 4,688,791 | 8/1987 | Long . | |
| 4,693,468 | 9/1987 | Kurlytis et al. . | |
| 4,739,984 | 4/1988 | Dranselka . | |
| 4,757,988 | 7/1988 | Szymski . | |
| 4,762,317 | 8/1988 | Camfield et al. . | |
| 4,776,583 | 10/1988 | Jennings . | |
| 4,824,102 | 4/1989 | Lo . | |
| 4,852,872 | 8/1989 | Lo . | |
| 5,178,593 | 1/1993 | Roberts | 482/62 |

OTHER PUBLICATIONS

American Express Merchandise Catalog Oct. 1986, p. 44.

*Primary Examiner*—Stephen R. Crow
*Attorney, Agent, or Firm*—J. M. Gilbreth

[57] ABSTRACT

Disclosed is an exercise apparatus that is a combination stationary recumbent cycle-type exerciser and an upper body exerciser, and a method of exercising. In the stationary recumbent cycle mode, the seated operator pedals a conventional pedal mechanism. In the upper body exerciser mode, the operator is in a normal push-up position with the hands on the pedals of the pedal mechanism. Exercising is accomplished by hand pedaling the pedal mechanism while supporting the body weight on the feet and hands. The machine has an adjustment to help support the operator's chest with a chest pad.

13 Claims, 3 Drawing Sheets

COMBINATION STATIONARY RECUMBENT EXERCISE APPARATUS AND UPPER BODY EXERCISER

This is a continuation, of application Ser. No. 07/726,278 filed Jul. 5, 1991, now U.S. Pat. No. 5,178,593.

BACKGROUND OF THE INVENTION

1. Field of the Invention

This invention relates generally to exercise equipment. In another aspect this invention relates to a recumbent exercise apparatus. In yet another aspect this invention relates to a push-up apparatus and a method of exercising the muscles of the upper body. In still yet another aspect this invention relates to a combination recumbent exercise apparatus and push-up machine, and a method of exercising the muscles of the upper body.

2. Description of the Related Art

The need for regular exercise is widely recognized. While running (or jogging) is a traditional method of exercise it is also recognized that running has disadvantages. Mostly, running is an outdoor activity which is practiced on public streets, roads, and sidewalks. Vehicle traffic is an ever present danger. Bad weather makes it disagreeable. There is no way of measuring the work expended. Heat monitors are used by some runners, but there is little if any relationship between the readings and muscle work output. Special footwear is required to prevent foot and leg injuries. Many people, due to excess weight, arthritis, bad feet or legs, or other ailments, simply cannot run. Even for a healthy individual, the pounding that the body absorbs during running may be injurious to the knees, feet, back and other parts of the body.

There are other traditional types of exercising such as swimming, bicycling, or racket sports. However, while these types of activities are quite popular, there still remains a need for alternative methods of exercise where the other methods are inconvenient or not available, such as, for example, where outdoor activities are limited because of weather, general surroundings such as city streets, the particular time of day, e.g. after nightfall, and the like. Other exercise activity, such a swimming or racket sports, require pools or specialized court facilities which are oftentimes either crowded or unavailable.

Recognizing the disadvantages of traditional exercise activities and methods, there have been many types of stationarycycle-type exercise machines developed in the prior art which are designed to provide the user with an exercise alternative to running, swimming or other activities.

In the simplest of these stationary cycle-type exercise machines, the user is seated in a traditional "bicycle" position and peddles the stationary bicycle. These conventional exercise bicycles employ mechanical arrangements of various types to vary the load or resistance which the rider must overcome to pedal the bicycle. However, these types of machines have a disadvantage of only exercising the muscles of the legs and lower torso. Also, some users object to sitting in the traditional bicycle position which requires a body posture which is generally uncomfortable and unstable.

In an effort to overcome the disadvantages of the simple conventional exercise bicycles and provide a means to also exercise the muscles of the upper torso, there have been provided in the prior art machines that exercise the muscles of both the upper and lower body. Such a stationary cycle-type exerciser which exercises the whole body through the arms and legs is a great improvement over running. It can be used indoors, is safe from traffic hazards, entirely independent of inclement weather. Work input is precisely measurable. Exercise bicycles also tend to impose less of a pounding on the body as compared to running, thus lessening the likelihood of injuries. And most people, regardless of weight, size or physical problems, can use one.

The following are several examples of exercise machines that provide for means to exercise the muscles of both the upper body and lower body.

U.S. Pat. No. 4,188,030, issued Feb. 12, 1980 to Hopper discloses a cycle exerciser which effectively works muscles in the arms, legs, and upper and lower torso simultaneously. This exerciser allows the seated user to peddle with the legs while simultaneously exercising the arms with a rowing motion. This machine is marketed by Schwinn Bicycle Company as the "AIRDYNE ®" exercise. Similar types of machines are disclosed in U.S. Pat. Nos. 4,757,988 issued Jul. 17, 1988 to Szymski, 4,762,3I7 issued Aug. 8, 1988 to Camfield et al., 4,824,102 issued Apr. 25, 1989 to Lo, and 4,852,872 issued Aug. 1, 1989 to Lo.

U.S. Pat. No. 4,739,984, issued Apr. 26, 1988 to Dranselka discloses a portable exercising machine which allows the seated user to pedal the pedal mechanism with either the hands or the feet.

U.S. Pat. No. 4,423,863 issued Jan. 3, 1984 discloses a stationary exercise bicycle having a hand operated cranking mechanism for rotating the front wheel and a peddle operated cranking mechanism for rotating the rear wheel, so that the seated exerciser may exercise both the arms and legs simultaneously.

U.S. Pat. No. 3,744,480 issued Jul. 10, 1973 to Gause et al., discloses an exercise machine having a pedal driven load that may be pedaled by a seated user, or hand cranked by a prone user. In the prone position, the user's body is supported from about the ankles to the chest by a padded table. Leg supports and a belt secure the operator to the table, thus greatly restricting the movement of the user's body.

While there are prior art machines that do provide means for exercising the muscles of the upper and lower body, they do not provide a means for rigorously exercising the muscles of the upper body with rigor at least equivalent to push-ups or the bench press. Therefore, a need exists for an exercise machine that both provides for exercising the legs and provides for rigorously exercising the muscles of the upper body.

SUMMARY OF THE INVENTION

It is therefore, an object of the present invention to provide a new, useful, unique, efficient and effective device and method for exercising the legs and for rigorously exercising the muscles of the upper body.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

According to one embodiment of the present invention there is provided an exercise apparatus that is a combination stationary recumbent cycle-type exerciser and upper body exerciser. The apparatus consists of a frame which supports a seat, a conventional pedal mechanism, a positioning support, and an energy absorber. In operation as a stationary recumbent cycle-type exerciser, the operator sits in the seat and pedals the pedal mechanism. In operation as an upper body exercise, the operator mounts the apparatus in a prone push-up position with feet placed on stirrups on the seat and hands gripping hand pedals on the pedal type mechanism. Ideally the operator would support the body in a push-up position while pedaling the pedal mechanism. For those weaker, less athletic operators, there is provided a positioning support pad that can be used to balance the user while mounting the apparatus and/or to partially support the user during exercise.

According to another embodiment of the present invention there is provided a method of exercising a human body having hands and feet, the method comprising hand pedalling an exercise apparatus with a pedal apparatus wherein the body is in a prone position apart from the exercise apparatus except for the hands and the feet which are in contact with the exercise apparatus, with essentially all of the body weight supported upon the hands and feet.

It is anticipated that the present invention can be utilized to exercise the muscles of the legs and upper body, including the quadriceps, hamstrings, biceps, triceps, pectorals, deltoids, abdominals, and latissimus dorsi.

BRIEF DESCRIPTION OF THE DRAWINGS

So that the manner in which the above-recited features, advantages and objects of the invention, as well as others which will become clear, are attained and can be understood in detail, more particular description of the invention briefly sumarized above may be had by reference to certain embodiments thereof which are illustrated in the appended drawings, which drawings form a part of this specification. It is to be noted, however, that the appended drawings illustrate preferred embodiments of this invention and are therefore not to be considered limiting of its scope, for the invention may admit to other equally effective equivalent embodiments.

DETAILED DESCRIPTION OF THE INVENTION

The present invention is an apparatus that can be operated in one mode as a recumbent stationary cycle-type exerciser and in another mode as an upper body exerciser. The present invention is best described by reference to FIGS. 1–4.

Figure 1:
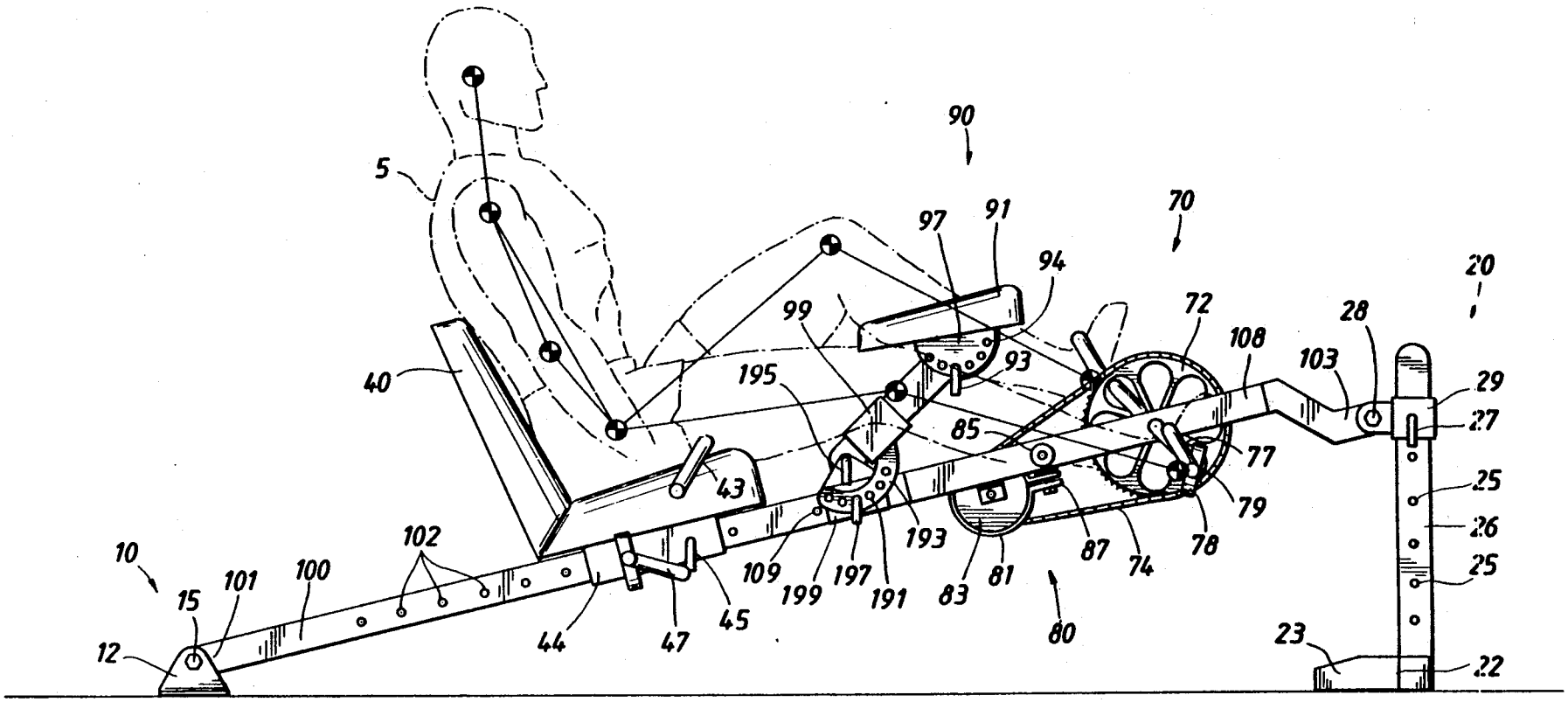
FIG. 1 is a side view of the present invention showing its operation as a stationary recumbent cycle-type exerciser.
Figure 2:
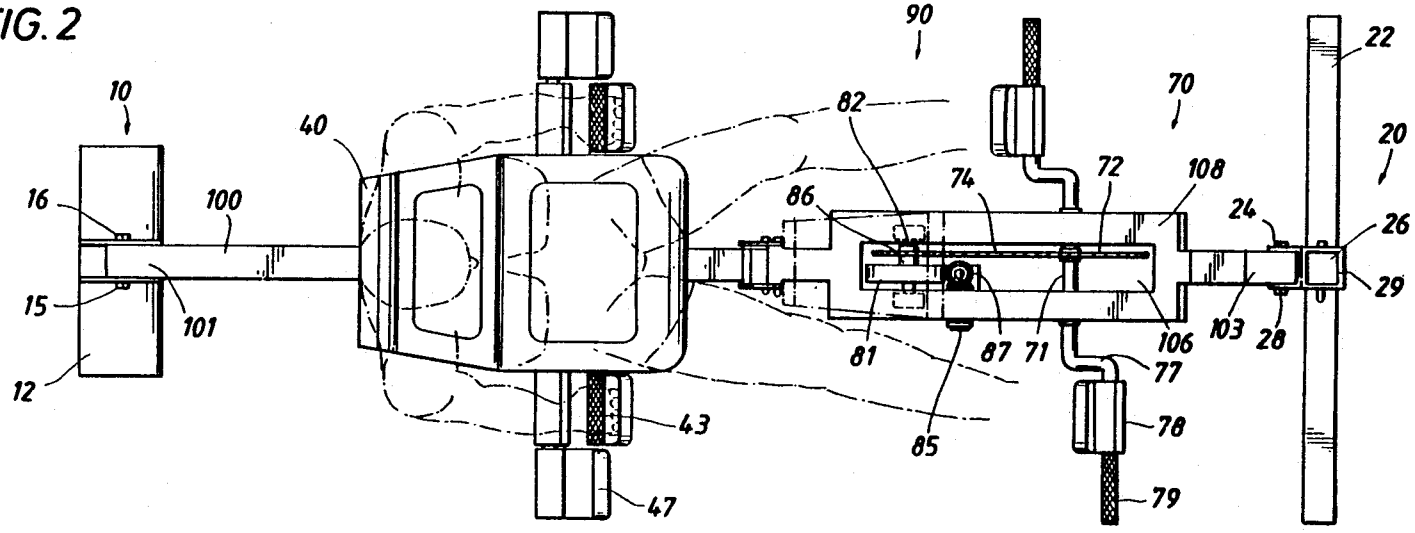
FIG. 2 is a top view of the present invention showing its operation as a stationary recumbent cycle-type exerciser.

FIG. 1 is a side view, and FIG. 2 is an overhead view of the apparatus of the present invention operated as a stationary recumbent exerciser.

The present invention generally comprises a support frame 100 that is supported at its front end by front support member 20 and at its back end by back end support 10. Slidably mounted upon support member 100 is seat 40. Mounted on support member 100 in front of seat 40 is the pedal mechanism 70 and energy absorber 80. Mounted on support member 100 between seat 40 and pedal mechanism 70 is positioning support member 90.

Support frame 100 is generally an elongated member adapted to support seat 40, pedal mechanism 70, energy absorber 80 and positioning support 90. Support frame 100 may have any suitable cross-sectional shape. Suitable cross-sectional shapes of support frame 100 include square or circular. In the embodiment shown, support frame 100 has a square cross-sectional shape.

The support frame 100 of the present invention is not intended to be limited by a particular material of construction. Any material that can withstand the rigors of operation may be utilized. Suitable materials include metals, alloys, high strength plastics, and fiber reinforced materials such as graphite reinforced plastic materials.

Support frame 100 must be long enough to accommodate the seat 40 and the pedal apparatus 70. It also must be long enough to accommodate operation as an upper body exercise machine. Generally support frame 100 is at least 5 feet long and preferably is in the range of about 6 feet to about 8 feet long.

At its back end 101, support frame 100 is connected to back end support 10. Support frame 100 is pivotally connected to back end base member 12 by pivot pin 15 and fastener 16. In the embodiment shown, pivot pin 15 is a bolt and fastener 16 is a nut adapted to fit bolt 15. In this arrangement, support member 100 pivots on pivot pin 15 as its front end 103 is moved up or down.

Back end base member 12 extends laterally away from support frame 100 to provide laterally stability. The exact dimensions of back end base member 12 will depend upon design and safety considerations, but generally, base member 12 will extend laterally away from the apparatus on each side at least 6 inches. In the embodiment shown, base member 12 extends laterally away from the apparatus on each side about 8.25 inches.

Back end base member 12 is also provided with a non-slip surface on its bottom, so that as it contacts the floor, it will tend to resist slipping during operation. Such non-slip surfaces are well known and any suitable may be used.

At its front end 103, support frame 100 is connected to front end support 20.

Front end support 20 consists of front end base member 22 and height adjustment bar 26 which extends vertically from front end base member 22. Height adjustment sleeve 29 can be made to traverse height adjustment bar 26. Height adjustment sleeve 29 may be held at a desired height by height adjustment pin 27 which holds height adjustment sleeve 29 by engagement through a selected height adjustment slot 25 which are disposed along height adjustment bar 26. Front end 103 is pivotally mounted to height adjustment sleeve 29 by pivot pin 28 and fastener 24. In the embodiment shown pivot pin 28 is a bolt and fastener 24 is a nut adapted to fit bolt 28.

Front end base member 22 also helps to provide the apparatus with lateral stability by extending laterally out on each side. The exact dimensions of back end base member 22 will depend upon design and safety considerations but generally, base member 22 will extend laterally away from the apparatus on each side at least 12 inches. In the embodiment shown, base member 22 extends laterally away from the apparatus on each side about 19.125 inches.

As with back end base member 12, the bottom of front end base member 22 is adapted to be resistant to slipping through the use of non-slip material.

In the embodiment shown, back end base member 12 and front end base member 22 are both freestanding. As such, front end base member 22 must also be shaped to provide axial stability so that the apparatus will not fall in on itself. This is provided by front end base axial stabilizer 23 which helps to stabilize the apparatus. Generally axial stabilizer is at least about 6 inches long, although the exact dimensions will depend upon design and safety considerations.

In an alternative embodiment, back end base member 12 and front end member 22 could both be mounted to a platform base for stability thus eliminating the need for non-slip surfaces on the bottom of the bases. Of course, either front support 20 or back support 10 would have to be slidable in the axial direction to accommodate the height adjustment of front end 103.

In yet another alternative embodiment, back end 101 of support member 100 could be vertically adjustable by replacing support member 10 as shown with a variable height support member similar to support member 20.

Seat 40 is slidably affixed to support frame 100 by seat attachment sleeve 44. Seat attachment sleeve 44 is adapted to be movable along support member 100. Seat positioning pin 45 anchors seat 40 in a position by its insertion into and engagement with seat position slots 102. Seat handles 43 are provided on each side of seat 40 to allow the exerciser 5 to hold on for stability during operation. In an alternative embodiment, a seatbelt may be provided to help maintain the user 5 in position.

Seat 40 is preferably padded for comfort, and is constructed of materials suitable to endure the rigors of exercise use to which the seat will be subjected. Typically the seat is covered with plastic, vinyl or other material suitable to withstand repeated and prolonged exposure to perspiration. Handle 43 may be suitably padded to provide a comfortable non-slip grip and also withstand repeated and prolonged exposure to perspiration.

Preferably, seat 40 is body contoured to provide for optimum comfort of exerciser 5 and to provide full back support.

Seat 40 also comprises foot stirrups 47 affixed to seat adjustment sleeve 44 in which operator 5 places both feet when the apparatus is operated in the upper body exerciser mode.

Positioning support 90 serves no purpose while the apparatus is operated as a stationary recumbent bicycle exerciser. It must however, not impede operation of pedal mechanism by exerciser 5.

Figure 4:
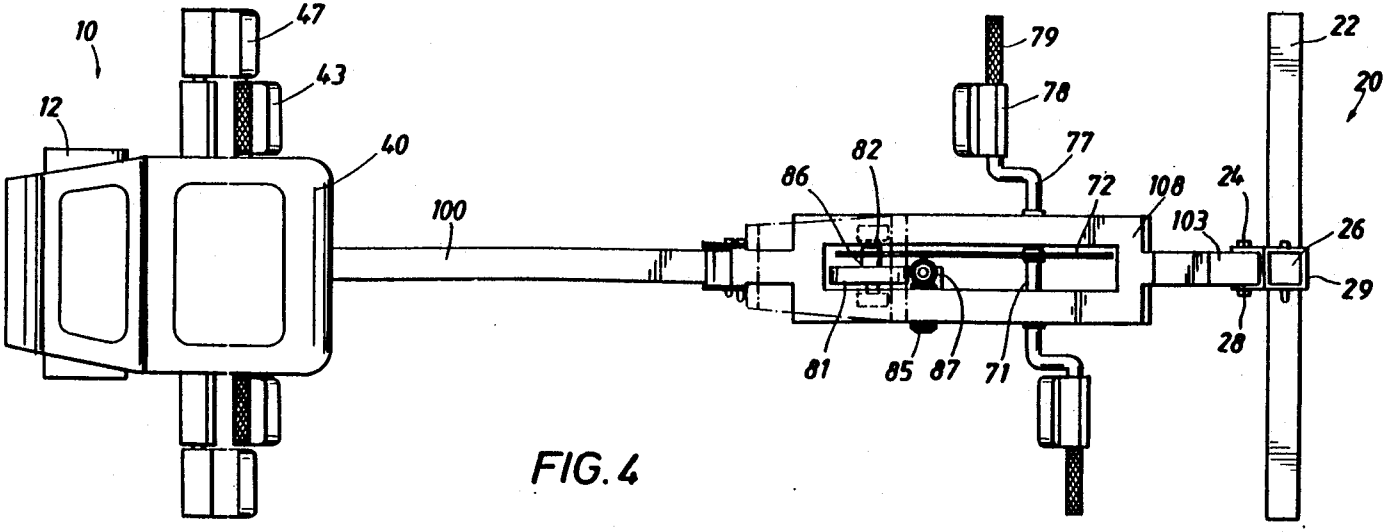
FIG. 4 is a top view of the present invention illustrating its operation as an upper body exerciser.
Figure 3:
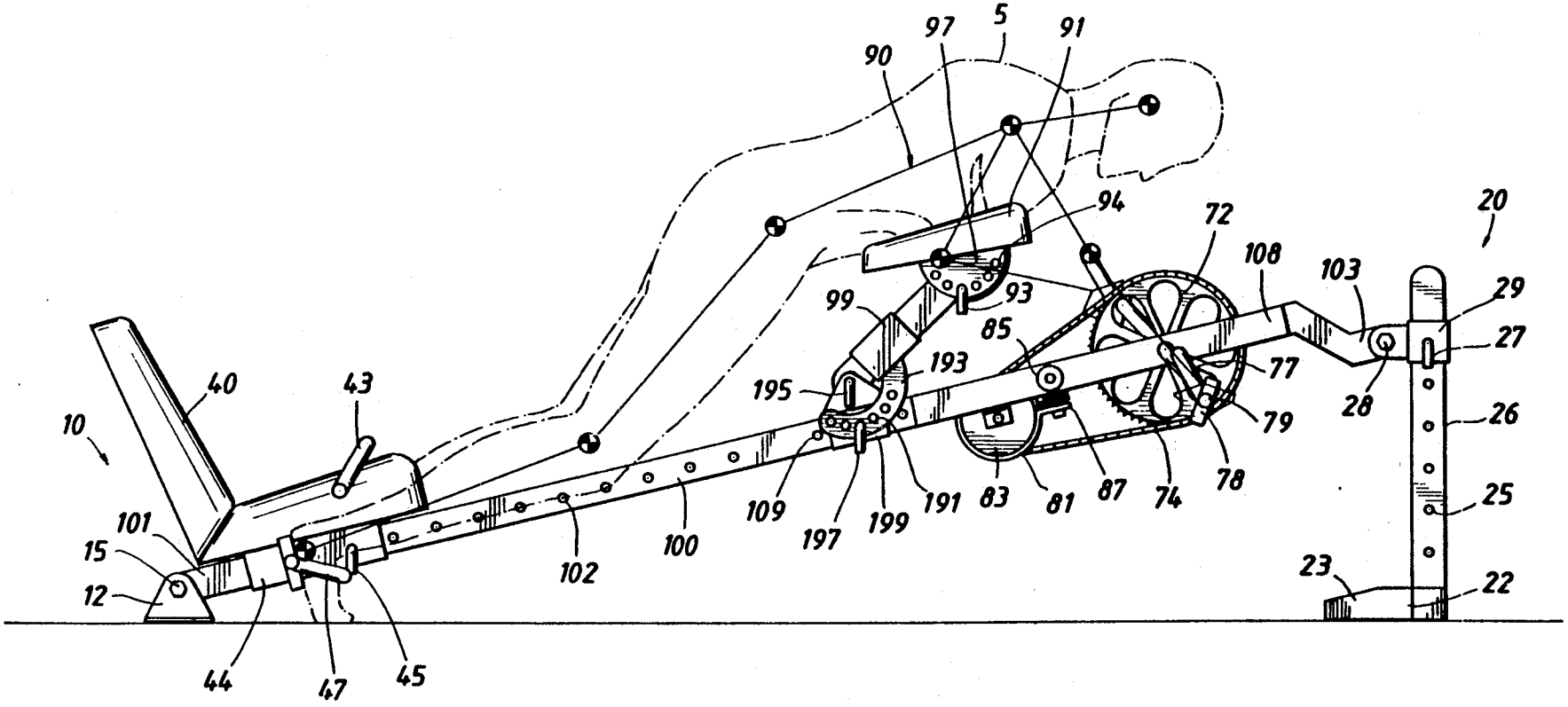
FIG. 3 is a side view of the present invention illustrating its operation as an upper body exerciser.

When the present invention is utilized as an upper body exerciser, referring additionally to FIGS. 3 and 4, positioning support 90 serves to help balance or position user 5 while the user is assuming the prone push-up position. Once the user is in the prone push-up position, positioning support 90 is ideally not utilized during exercising. With less athletic or weaker users, positioning support 90 can be utilized to help support at least a portion of the user's body weight during exercises. Optionally, with strong athletic users, the positioning support 90 may be removed.

Positioning support 90 consists of pad 91 which is generally padded for the comfort of user 5. Pad 91 further comprises pad carriage 97 which contains a multiplicity of pad positioning slots 94. Pad 91 is secured to positioning support arm 99 by pad positioning pin 93 which engages a slot (not shown) or positioning support arm 99 and a selected pad positioning slot 94. At its lower end, positioning support arm 99 is rotatably connected to sleeve 199 by pivot pin 195. Positioning arm 99 may be moved to different radial positions by selection of the desired carriage slot 191 on carriage 193. Positioning arm 99 is then secured in its radial location by pin 197 which engages a slot (not shown) through sleeve 199 and support member 100 and the desired carriage slot 191.

Pedal mechanism 70 is mounted on support member 100 in front of positioning support 90. As shown in FIG. 2, support member 100 is split to admit pedal mechanism through slot 106. At this point, support member 100 acts as a housing 108 around pedal mechanism 70.

Pedal mechanism 70 is a conventional pedal crank assembly, with crank shaft 71 which carries at one side pedal mechanism drive sprocket 72, which is a conventional drive sprocket. Pedal mechanism is further composed of conventional cranks 77 with foot pedals 78 and hand pedals 79.

Preferably, toe clips are connected to the toe pedals for providing lifting and pulling flexure as well as pushing extension to user 5.

While any suitable type of chain 74 may be utilized, in the embodiment shown, chain 74 is a standard bicycle type roller chain which extends around pedal mechanism drive sprocket 72 and energy absorber sprocket 82 in the conventional way.

The energy absorbance function of exercise machines is attended to in a variety of ways and involves some form of resistance which is preferably variable to enable variation of work output of the user.

The present invention is not intended to be limited to any one type of energy absorber. In the embodiment shown, energy absorber 80 is a frictional type of energy absorber system. Energy absorber system. Energy absorber control 85 is operably connected to energy absorber friction mechanism 87 which tightens or loosens friction band 81 which extends around and engages energy absorber friction pulley 83. Energy absorber friction pulley 83 is connected to energy absorber sprocket 82 via energy absorber shaft 85.

In one alternate embodiment of the present invention, energy absorber 80 comprises a rotating disc/braking means operably connected to pedal mechanism 70. In a simple system, the brake is set by the exerciser to determine the exercise load. In a complex system, there are speed sensing means that signal a feedback loop which adjusts the braking means as the disc speed varies. A control means is connected to the feedback means for controlling ratio of feedback compared to disc rotation, whereby a user may adjust a ratio of braking to speed.

In one alternative embodiment the energy absorbing means 80 comprises an electrical generator coupled to the pedal mechanism 70, load means electrically connected to the generator and sensing means connected to an electrical connection between the load means and the generator.

In another alternative embodiment of the present invention, the energy absorbing means 80 comprises an electromagnetic brake coupled pedal mechanism 70. A rate-of-rotation sensor senses the pedal rotational speed. Current adjusting means is connected to the sensor and to the electromagnetic brake for varying braking as pedal rotation rate varies. A magnetic brake controller means is connected to the electromagnetic brake so that the user may control ratio of braking to pedal rotational speed.

In another alternative embodiment of the present invention, the energy absorbing means 80 includes a fan or rotor which is operable engaged with the pedal mechanism 70 to displace air. One advantage of such an air displacement energy absorbing system is that the displaced air can be directed toward the operator 5 to cool operator 5 during exercise to substantially increase the operator's comfort, particularly during long periods of use.

In another alternative embodiment of the present invention, the energy absorbing means 80 is a pump coupled to the output of pedal mechanism 70. Intake and output means are connected to the pump. A hydraulic fluid reservoir is connected to the intake means for supplying hydraulic fluid to the pump. A flow control means connected to the valve controls restriction of the valve. A pressure transducer connected to the output converts hydraulic pressure in the output to electrical voltage. A meter connected to the transducer indicates power. Feedback means connected to the transducer means and to the control means controls the valve in response to electrical output of the transducer. A smoother is connected to the output of the transducer. A smoother is connected to the output for smoothing pressure surges in the output.

While not shown, it is envisioned that the chain and gears of pedal mechanism 70 and energy absorber 80 would be covered by a housing for neatness of appearance, acoustic insulation, and safety.

In operation as a recumbent cycle-type exerciser, operator 5 removes height adjustment pin 27, moves height adjustment sleeve 29 to the proper desired height, and secures the front end of the apparatus in place by inserting height adjustment pin 27 into the appropriate height adjustment slot 25.

Next, the position of seat 40 is adjusted to a desired position by removing seat positioning pin 45 and sliding the seat 40 and seat attachment sleeve 44 along support member 100 until the desired position is obtained. Pin 45 is then reinserted into the appropriate seat adjustment slot 102 to anchor seat 40 into place.

Sitting in seat 40, the operator then places the appropriate foot on the appropriate pedal and while gripping hand grips 43 pedals the pedal mechanism 70 for kinesthetic enjoyment.

While the present upper body exerciser is shown with the user's feet in the stirrups, it is understood that the users feet could be apart from the apparatus, and actually supported by a support means appart from the upper body exerciser, such as by another apparatus, on another surface, the floor or the ground.

In operation as an upper body exerciser, operator 5 again positions the front of the apparatus at the desired height by removing height adjustment pin 27, moving height adjustment sleeve 29 to the desired height, and reinserting height adjustment pin 27 in the appropriate height adjustment slot 25.

The seat 40 must be placed in its desired position for use of the apparatus as an upper body exerciser. Seat 40 must be positioned so that as operator 5 is in a prone position with feet in stirrups 47, and where operator 5 is able to hand pedal the pedal mechanism 70. Again, seat 40 is adjusted by removing seat positioning pin 45, sliding seat 40 to the desired position and reinserting pin 45 into the appropriate seat adjustment slot 102.

If operator 5 is strong and athletic enough, then the positioning support 90 may be removed by removing pin 195 and pin 197. However, it is anticipated that beginners will need to utilize positioning support 90 to at least help balance or position them as they mount the present apparatus when it is in the upper body exercise mode. With most beginners, it is also anticipated that positioning support 90 will be needed to support some of the operator's body weight during exercising.

Pad 91 is rotated into the desired position by removing pin 93, rotating pad 91 and reinserting pin 93 into the appropriate slot 94. Pad 91 is also adjusted by removing pin 197, moving the support arm 99 to the appropriate position and reinserting pin 197 in the appropriate slot 191.

Operator 5 then mounts the upperbody exercise by placing the chest on pad 91, the feed in stirrups 47 and the hands on hand pedals 79. To exercise, the operator 5 hand pedals pedal mechanism 70. Ideally, substantially all of operator's body weight would be supported on the hands and feet, with none or almost none supported by the chest on pad 91.

In the upper body mode, the present apparatus provides for the exercising of the body muscles including those of the arms, chest, back, neck, and abdomen, for example including but not limited to biceps, triceps, pectorals, deltoids, abdominals and latissimus dorsi. In addition, while mounted on the machine with the body in the push-up position, other muscles in the body, such as those in the legs and buttocks are held rigid and will therefore receive some conditioning (e.g. toning).

It is also understood that various types of readout gauges, monitoring equipment, computers and microchips may be adapted to the present invention.

The present invention may be equipped with a speedometer, odometer, or calorimeter. Timers may be adapted to the present invention that measure split times, total time, and that set a pace through an indication such as rhythmic beeping.

The present invention may also be equipped with various electrical sensing devices to monitor metabolic functions and a recording device to permanently record test results for comparison to future tests.

The description given herein is intended to illustrate the preferred embodiments of the present invention. It is possible for one of ordinary skill in the art to make various changes to the details of the present invention, including changes in the size, shape and materials, as well as in the details of the illustrated construction without departing from the spirit of this invention. Therefore, it is intended that all such variations be included within the scope of the present invention as claimed.

I claim:

1. A dual use exercise apparatus for exercising body muscles of a human body in a prone or seated position comprising:

(a) a frame;

(b) a pedal means affixed to the frame and adapted to be operated by hands in the prone position or feet in the seated position;

(c) a seat affixed to the frame for providing a seat for a recumbent exercise cycle during operation in the seated position; and, (d) a pair of foot stirrups affixed to the frame each adapted to receive a foot;

wherein the pedal means and the foots stirrups are adapted such that during operation in the prone position the body is maintained in a substantially prone position and essentially all of the body weight is supported by hands on the pedal means and by feet in the stirrups.

2. The apparatus of claim 1 wherein the apparatus comprises means to vary the pedal resistance.

3. The apparatus of claim 1 wherein the apparatus comprises means to determine at least one parameter selected from the group consisting of exercise time, heart rate, pedal revolutions, work exerted and metabolic functions.

4. The apparatus of claim 1 wherein the stirrups are slidably affixed to the apparatus so that the distance between the stirrups and the pedal means can be varied.

5. The apparatus of claim 1 further comprising means to vary to vertical relationship between the stirrups and the pedal means.

6. A dual use exercise apparatus for exercising body muscles of a human body in a prone or seated position comprising:

(a) a frame;

(b) a pedal means affixed to the frame and adapted to be operated by hands in the prone position or feet in the seated position;

(c) a seat affixed to the frame for providing a seat for a recumbent exercise cycle during operation in the seated position; and, (d) a pair of foot stirrups affixed to the frame each adapted to receive a foot and be immovable during operation in the prone position;

wherein the pedal means and the foots stirrups are adapted such that during operation in the prone position the body is maintained in a substantially prone position and essentially all of the body weight is supported by hands on the pedal means and by feet in the stirrups.

7. The apparatus of claim 6 wherein the apparatus comprises means to determine at least one parameter selected from the group consisting of exercise time, heart rate, pedal revolutions, work exerted and metabolic functions.

8. The apparatus of claim 6 wherein the stirrups are slidably affixed to the apparatus so that the distance between the stirrups and the pedal means can be varied.

9. The apparats of claim 6 further comprising means to vary the vertical relationship between the stirrups and the pedal means.

10. A dual use exercise apparatus for exercising body muscles of a human body in a prone or seated position comprising:

(a) a frame;

(b) a pedal means affixed to the frame and adapted to be operated by hands in the prone position or feet in the seated position;

(c) a seat affixed to the frame for providing a seat for a recumbent exercise cycle during operation in the seated position;

(d) a pair of foot stirrups affixed to the frame each adapted to receive a foot; and, (e) a chest support means affixed to the frame and adapted to support the chest of the human body above the pedal means to assist in mounting the apparatus during operation in the prone position.

11. The apparatus of claim 10 wherein the apparatus comprises means to determine at least one parameter selected from the group consisting of exercise time, heart rate, pedal revolutions, work exerted and metabolic functions.

12. The apparatus of claim 10 wherein the stirrups are slidably affixed to the apparatus so that the distance between the stirrups and the pedal means can be varied.

13. The apparatus of claim 10 further comprising means to vary the vertical relationship between the stirrups and the pedal means.

* * * * *